US007134887B1

(12) United States Patent
Keely

(10) Patent No.: US 7,134,887 B1
(45) Date of Patent: Nov. 14, 2006

(54) WALL SOCKET CONNECTOR FOR AC ADAPTERS

(75) Inventor: Leroy B. Keely, Portola Valley, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/170,787

(22) Filed: Jun. 30, 2005

(51) Int. Cl.
*H01R 13/44* (2006.01)

(52) U.S. Cl. ..... 439/131; 439/172

(58) Field of Classification Search ..... 439/131, 439/172
See application file for complete search history.

(56) References Cited

U.S. PATENT DOCUMENTS 5,494,449 A * 2/1996 Chioo ..... 439/76.1
6,402,546 B1 * 6/2002 Groves et al. ..... 439/501
6,722,900 B1 * 4/2004 Segawa et al. ..... 439/131
6,939,150 B1 * 9/2005 Lanni ..... 439/131

OTHER PUBLICATIONS

Delta Electronics, Inc.—Power Management; http://www.delta.com.tw/product/ps/adapter/adapter_product.asp?pcid=1&ptid=1, date printed Apr. 7, 2005, 4 pages.

Switch Channel-2-Prong IEC 320-C8 Low-Current Power Inlet Connector (ST-02), http:www.switchchannel.com/products/receptacle/st02/index.htm, date printed Apr. 7, 2005, 2 pages.

Kensington® Universal AC/Car/Air Adapter for Apple, http://www.kensington.com/html/3722.html, date printed May 11, 2005, 1 page.

Kensington® Product Specification Sheet 33069, http://www.kensington.com/images/pc/K33069-2181.jpg. date printed May 11, 2005, 2 pages.

Kensington® Universal Laptop Power Supply, http://www.kensington.com/html/5406.html, date printed May 11, 2005, 2 pages.

Kensington® Product Specification Sheet 33173, http://www.kensington.com/images/pc/K33173-10693.jpg, date printed May 11, 2005, 2 pages.

Kensington® Notebook Accessories, http://www.kensington.com/html/1422.html, date printed May 11, 2005, 4 pages.

* cited by examiner

*Primary Examiner*—Tho D. Ta
(74) *Attorney, Agent, or Firm*—Banner & Witcoff, Ltd.

(57) ABSTRACT

An AC adapter assembly having an adapter with an AC input and a DC output, a wall socket connector that includes an AC input connector member configured for insertion into the input of the adapter and a plurality of prongs configured for both insertion into a wall socket and movable from an in-use position to a storage position and the wall socket connector is configured to remain within the thinnest dimension of the adapter; and a DC connector is described.

20 Claims, 8 Drawing Sheets

WALL SOCKET CONNECTOR FOR AC ADAPTERS

BACKGROUND

Mobile PCs, e.g. laptops, are common portable electronic devices. Many mobile PCs use an AC (alternating current) adapter that converts the alternating current from a wall outlet to DC (direct current) when a laptop is not running exclusively on a portable power source, e.g. batteries. An IEC-320 C8 Low Current Power Inlet Connector is a component very commonly used in conventional AC adapters at the inlet to the AC adapter. While the inlet of the AC adapter may be described as a generally universal component, wall socket connectors linking the wall socket to the IEC-320 C8 Low Current Power Inlet Connector vary in function and structure.

One wall socket connector available for use with mobile PCs is a separate cable for connection between the wall socket and the IEC-320 C8 inlet. This cable is typically bulky and limits the mobility of the PC, as the user must carry a bag in order to carry the adapter which they also must carry in order to recharge the batteries. Another, wall socket commonly referred to as a "duckhead" includes both the plug that fits into the adapter and the requisite prongs that connect the wall socket protruding from a single plastic shell. While some "duckheads" have movable prongs, most do not.

Non-movable prongs that protrude from the plastic shell hinder transport of the AC adapter and increase the risk of damage to the prongs during transport as well as objects that may scrape against the prongs.

SUMMARY

To overcome limitations in the prior art described above, and to overcome other limitations that will be apparent upon reading and understanding the present specification, aspects of the present invention are directed to a wall socket connector and an AC adapter assembly including a wall socket connector.

A first aspect of the invention provides a wall socket connector including a wall socket connecting element, an AC input connector member, and a housing rotateably linking the features described above.

A second aspect of the invention provides an AC adapter assembly including a wall socket connector, an adapter component and a DC connector, the assembly having an in-use position and a storage position.

A third aspect of the invention provides a fully integrated AC adapter assembly including a wall socket connector, an adapter component, a DC connector and a housing, the assembly having an in-use position and a storage position.

A fourth aspect of the invention provides an AC adapter assembly including a wall socket connector, an adapter component, and a DC connector that includes a retractable element.

A fifth aspect of the invention provides a wall socket connector including a wall socket connecting element, an AC input connector member, a housing rotateably linking the features described above, and user assisting elements placed on the wall socket connector to facilitate use and manipulation of the wall socket connector.

DRAWINGS

A more complete understanding of the aspects of the present invention and the advantages thereof may be acquired by referring to the following description in consideration of the accompanying drawings, in which like reference numbers indicate like features.

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be used and structural and functional modifications may be made without departing from the scope of the present invention.

It is noted that various connections are set forth between elements in the following description. It is noted that these connections in general and, unless specified otherwise, may be direct or indirect and that this specification is not intended to be limiting in this respect.

Numerous types of portable computers are commonly available including notebook computers, tablet computers, PDAs etc. It is common for portable computer manufacturers, e.g. laptop manufacturers, to provide AC adapters with their portable computers for use in powering the portable computers directly or for charging power supplies such as batteries.

Figure 1:
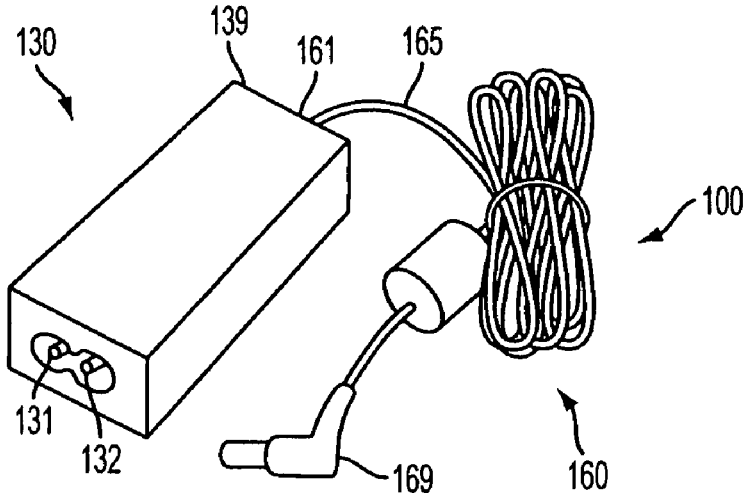
FIG. 1 PRIOR ART
FIG. 1 illustrates a perspective view of an illustrative embodiment of a conventional AC adapter and cord for use with a portable computer.

FIG. 1 illustrates a perspective view of an illustrative embodiment of a conventional AC adapter assembly 100 including an adapter 130 and a DC connector 160. Adapter 130 has input end 131 for inputting AC into the adapter from a wall socket and an output end 139 for outputting DC from the adapter for use in a portable computer. DC connector 160 is connected to output end 139 of the adapter by a DC input connector 161. An opposing end of DC connector 160 also has a DC output connector 169, typically configured to connect to a portable computer. DC input connector 161 is linked to DC output connector 169 by cord 165 which is bendable and generally permits universal motion of DC input connector 161 relative to DC output connector 169.

Figure 2:
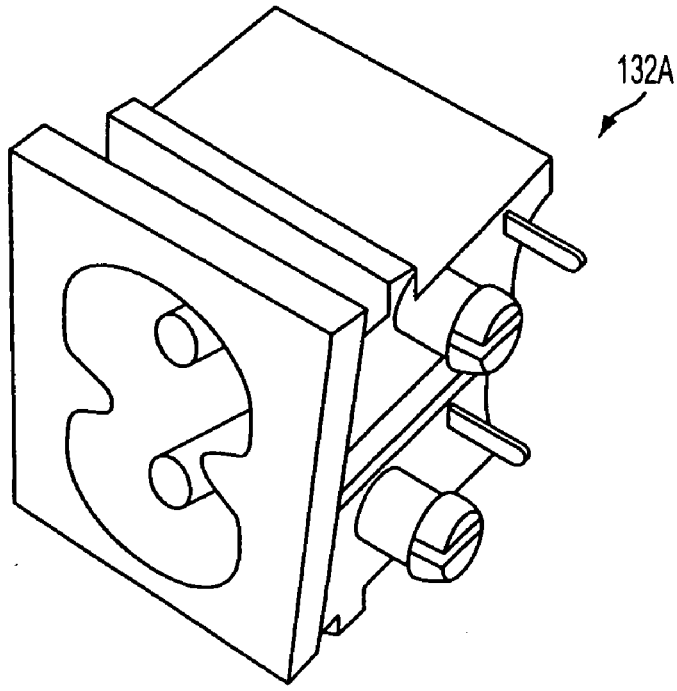
FIG. 2 PRIOR ART
FIG. 2 illustrates a perspective view of an illustrative embodiment of a IEC 320-C8 inlet connector.

While not depicted in FIG. 1, an adapter assembly typically also includes one of a number of conduits connecting input end 131 of the adapter to a power source, most often a wall socket, to permit AC to flow from the power source to adapter 130. AC adapter assemblies like the one depicted in FIG. 1 typically are constructed to conform to standards set by the International Electrotechnical Commission (IEC), among other potential bodies charged with developing standards for electrical components. Pursuant to the applicable IEC standard, an IEC 320-C8 Power Inlet Connector 132 is typically used as a connector located at end side 131 of adapter 103. FIG. 2 illustrates an illustrative embodiment of IEC 320-C8 Power Inlet Connector 132A typically located within adapter 130. Any of the IEC 320-C8 Power Inlet Connectors, hereafter referred to as "connector 132A," that are well known in the art may be used as a portion of AC adapter assembly 100.

As mentioned in the background, typical AC adapter assemblies use a wall socket connector mostly comprised of a lengthy and cumbersome cord that connects connector 132A to the wall socket for providing AC to adapter 130. In the alternative, a few AC adapter assemblies use a wall socket connector that uses a single plastic shell containing prongs and a plug for connection into connector 132A and are sometimes referred to as "duckheads." However, these current wall socket connectors or "duckheads" possess significant short comings. These shortcomings include a configuration that greatly increases the size of the adapter assembly including increase in the smallest dimension so as to complicate transport of the adapter assembly, a propensity for the assembly to fall from the wall socket while in use, and a requirement for customization of design that greatly increase the cost of manufacture, reduces interoperability, and increases confusion among users.

Figure 3A:
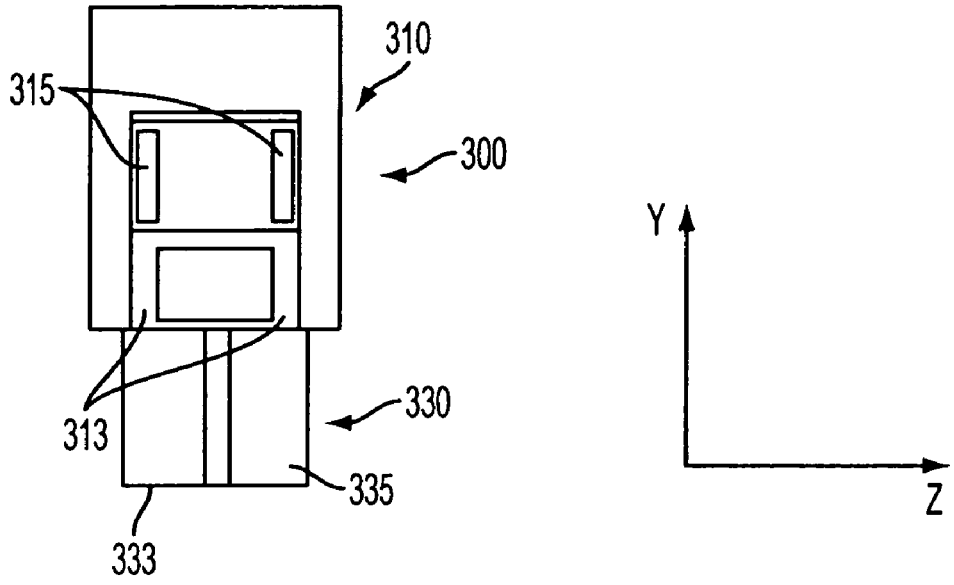
FIGS. 3A and 3B illustrate front and side views respectively of an illustrative embodiment of wall socket connector in an in-use position.
Figure 3B:
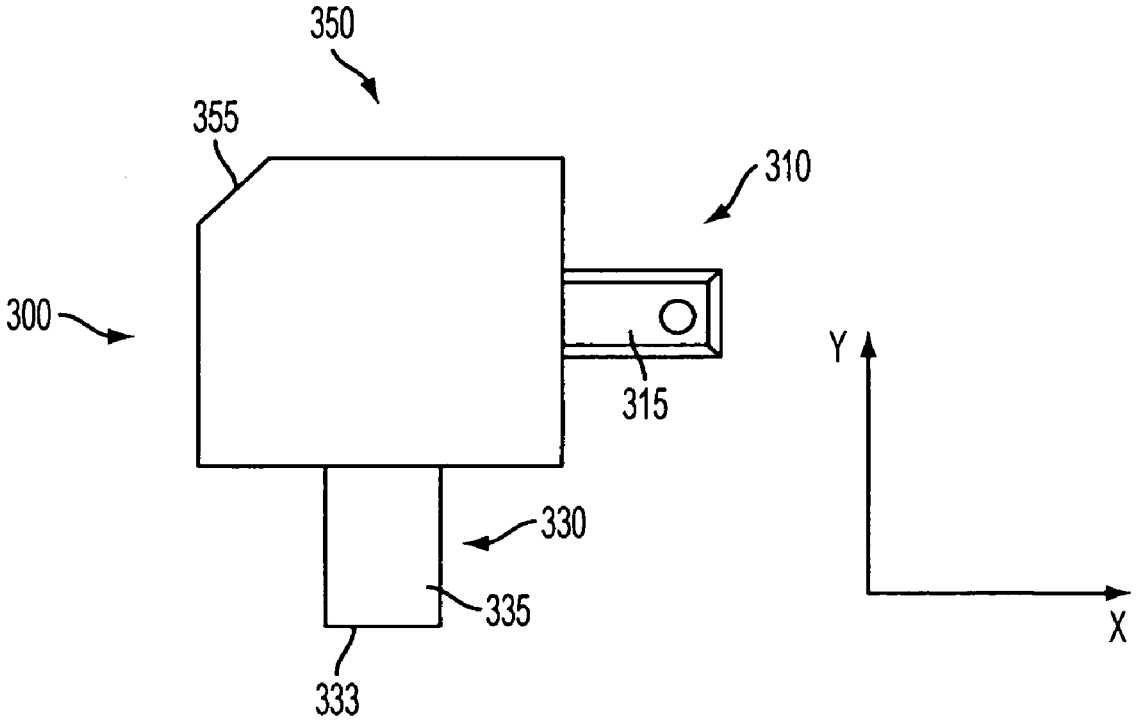
Figure 4A:
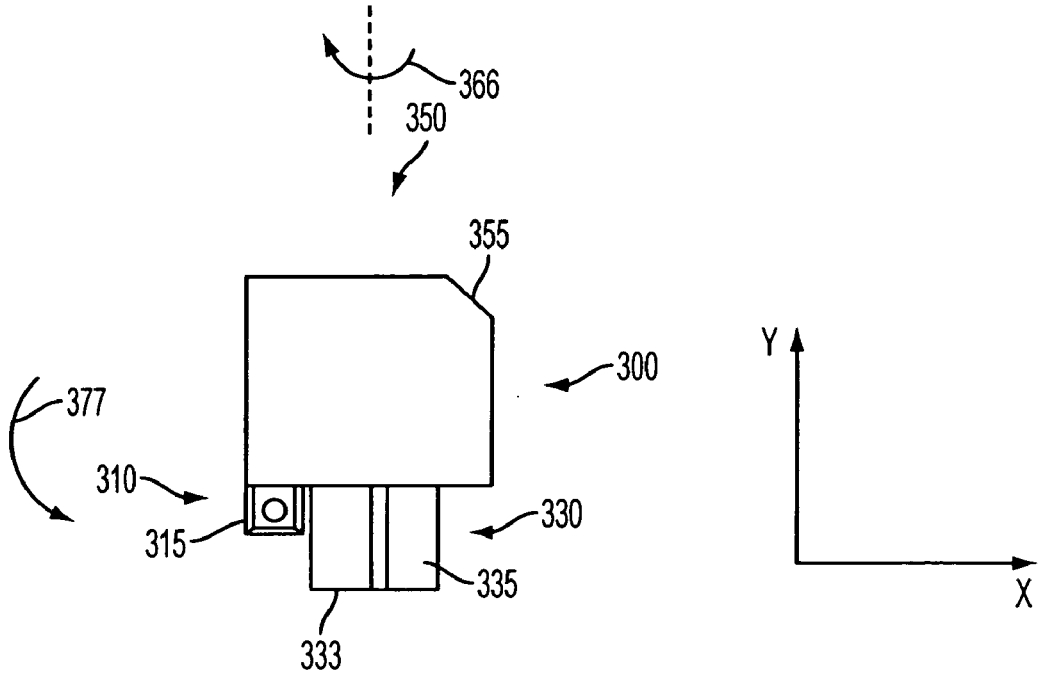
FIGS. 4A and 4B illustrate front and side views of an illustrative embodiment of a wall socket connector in a storage position.
Figure 4B:
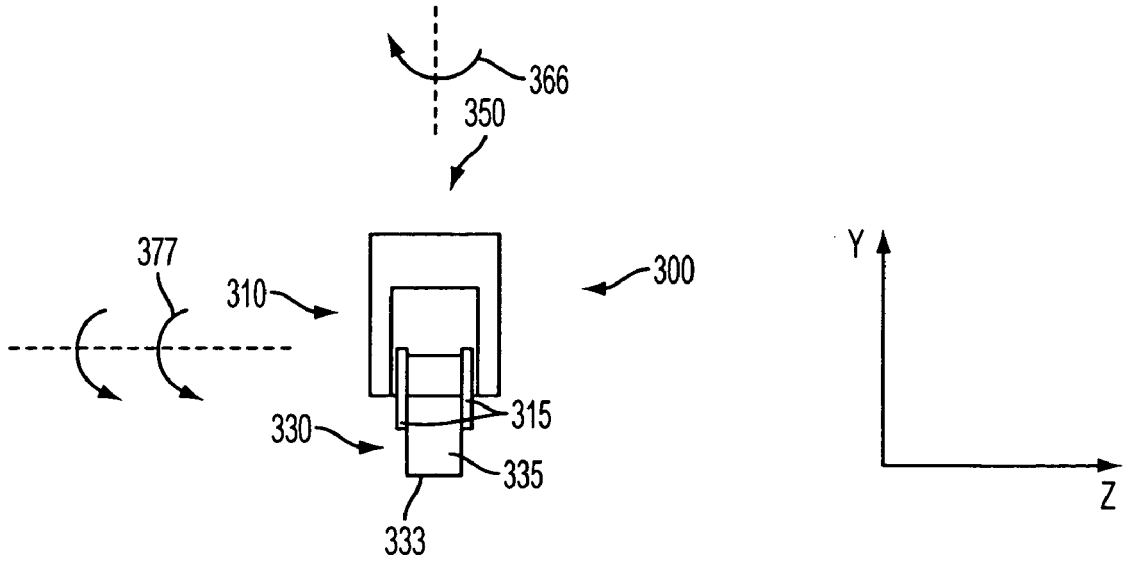

FIGS. 3A and 3B illustrate front and side views respectively of an illustrative embodiment of an improved wall socket connector 300 in an in-use position. FIGS. 4A and 4B illustrate front and side views respectively of wall socket connector 300 of FIGS. 3A and 3B in a storage position.

As depicted in FIGS. 3A and 3B, wall socket connector 300 can generally be described as having a wall socket connecting element 310, an AC input connector member 330, and a housing 350. Wall socket connecting element 310 is connected to housing 350 on a side of the housing and includes prongs 315, typically two or three in number, however more may be used, for connecting into a socket capable of outputting AC. At least two prongs 315 typically rest in a parallel position and complimentary sockets configured with at least a pair of parallel slits complimentary in size and orientation to facilitate prongs 315 into the sockets. Often the socket is a wall socket, however power supplies, extension cords, and similar sockets are also commonly used.

Connected to housing 350 on an alternate side, AC input connector member 330 includes a conduit 335 containing a IEC 320-C8 inlet connector 333 that connects to a connector 132A of adapter 130. Conduit 335, as depicted, has a shape that can be characterized as a double cylinder with a connecting strip located between the cylinders. IEC 320-C8 inlet connector 333, hereafter "inlet connector 333," is contained within conduit 335. When AC input connector member 330 is connected to adapter 130, at least a portion of conduit sits below the outermost surface of the end which it is connected to on adapter 130.

In FIGS. 3A and 3B, housing 350 connects wall socket connecting element 310 to AC input connector member 330 to permit wall socket connecting element 310 so as to permit movement of wall socket connecting element 310 relative to AC input connector member 330. For example, prongs 315 are moveable from a first position as shown in FIGS. 3A and 3B to a second position as shown in FIGS. 4A and 4B. Specifically, housing 350, including prongs 350, may be rotated 90 degrees in the direction shown by arrow 366 and prongs 315 may also be rotated 90 degrees in a direction as depicted by arrow 377, moving from the position in FIGS. 3A and 3B to the positions in FIGS. 4A and 4B. As depicted theses rotations are performed about axis that are perpendicular to each other. The positioning of wall socket connector 300 as shown in FIGS. 3A and 3B may also be referred to as an "in-use" position while the positioning of wall socket connector 300 in FIGS. 4A and 4B may also be referred to as a "storage position." Wall socket connector 300 will typically be positioned into the in-use position in order to be connected to a wall socket and used in conjunction with an adapter assembly 100 to provide power to a portable computer.

In the illustrative in-use position depicted in FIGS. 3A and 3B, prongs 315 runs generally perpendicular to AC input connector 330 as well as adapter assembly attached to AC input connector 330. When positioned in an in-use position, prongs 315 enable connection of a wall socket connector, including a generally rigid housing 350, into a wall socket as prongs 315 typically must be inserted several centimeters to properly permit the AC from the wall socket to flow to a device at the other end of wall socket connector 300.

While prongs 315 may be positioned generally perpendicular to AC input connector 330 when in-use, a second position wherein prongs 315 are positioned to be generally parallel to AC input connector member 330 is depicted in FIGS. 4A and 4B. From the in-use position of FIGS. 3A and 3B to an illustrative second position that may be referred to as a "storage position," prongs 315 are rotateable downward in a direction towards AC input connector 330 as is shown by the accompanying demonstrative arrows. Additionally, in FIGS. 3A, 3B, 4A, and 4B, rotation is shown as occurring in a constant x-y plane based upon the associated axis which have been placed in the figures to assist in understanding. While rotation in 2 planes facilitates simplicity of use and enables housing 350 to possess dimensions similar to that of adapter 130, prongs 315 could also be configured to possess 3 dimensional movement.

Prongs 315 are attached to housing 350 at a pivot (e.g. internal to housing 350 and not visible in FIGS. 3A, 3B, 4A or 4B) about which prongs 315 may be rotated. Any pivot well known in the art may be used and the pivot may also have numerous varied resistive characteristics. For example, the pivot may be damped so that a certain specific amount of force must be placed on it by a user. Typically, the pivot is sufficiently damped or resistive such that prongs 315 would be prevented from rotating from an in-use position to a storage position if the only force acting on it were a gravitational force. In order for rotation to occur, an additional force, often by a user, must be placed upon prongs 315.

To permit prongs 315 to rotate in a manner similar to that previously described, housing 350 may be configured and/or sized so as to permit rotation. In the embodiments depicted in FIGS. 3A–5B, housing 350 is configured and sized to have approximately the same width (x) and depth (z) as that of an associated adapter 130 of adapter assembly. The height and width are the smaller two of the three dimensions apparent in FIG. 1. Typical adapters have a smallest dimension typically the height, of approximately 1 inch or a little bit smaller. Therefore, in the illustrative embodiment depicted, wall socket connector 300 has at least one major dimension (length, width, height) that measures less than one inch. Of course, a wall socket connector 300, AC adapter assembly 100, and/or adapter 130 having dimensions with various specific measurements may be used.

Additionally, housing 350 is constructed to possess recesses 313 complimentary in size to corresponding dimensions of prongs 315 to allow prongs 315 to rotate into recesses 313 as wall socket connector 300 is converted from an in-use position to a storage position. The recesses 313 are typically molded as part of housing 350 during construction of housing 350. Recessess 313 are typically formed deep enough into housing 350 to permit prongs 315 to sit as shown in FIGS. 4A–4B.

As depicted in FIGS. 3A, 3B, 4A, and 4B, prongs 315 possess a range of motion of approximately 90 degrees, even though wall socket connector 300 may be configured to permit movement through a range of motion both greater or smaller than 90 degrees. However, 90 degrees may be a preferred range of motion for prongs 315 in the depicted illustrative embodiment from an in-use position to a storage position. Having a range of motion of 90 degrees, prongs 315 easily are placed by a user into a wall socket. Then, when the user desires to transport or store wall socket connector and/or any adapter assembly associated with wall socket connector 300, prongs 315 and housing 350 may be rotated 90 degrees about each of the aforementioned perpendicular axis so that prongs 315 do not extend beyond a perimeter defined by the front, back, and sides of housing 350. Once in a storage position as depicted, prongs 315 no longer protrude from a side surface of housing 350.

Accordingly, only a small portion of prongs 315 are visible and accessible when wall socket connector 300 is placed in the storage position of FIGS. 4A and 4B. While a significant portion of prongs 315 is contained within housing 350, the protruding portion of prongs 315 enables a user to access prongs 315 in the storage position depicted and re-position wall socket connector 300 back into the in-use position. Therefore, it is important for a portion of prongs 315 to be accessible by a user in the absence of alternative means for permitting a user to apply a force moving the prongs from a storage position to an in-use position. Movement in a direction directly opposite to the direction depicted in FIGS. 3A, 3B, 4A, and 4B is accomplished in the same manner as described previously but just in a direction directly opposite to the direction of the arrows.

While the protrusion of a portion of prongs 315 from the housing in a direction generally perpendicular to AC input connector member 330 acts as one illustrative user assisting element for manipulating wall socket connector 300 into various positions, additional user assisting elements may be used. For example, in the embodiment of FIGS. 3A and 3B, housing 350 includes user assisting element 355.

Here, user assisting element 355 is a chamfer. In general, user assisting elements may be recognizable to a user's senses thereby facilitating rapid and easy manipulation of wall socket connector 300. Typically, user assisting elements are perceptible by touch, sight or both. Many different user assisting elements including raised surfaces and grooves in addition to the depicted chamfer may be used to provide the desired effect.

Figure 5A:
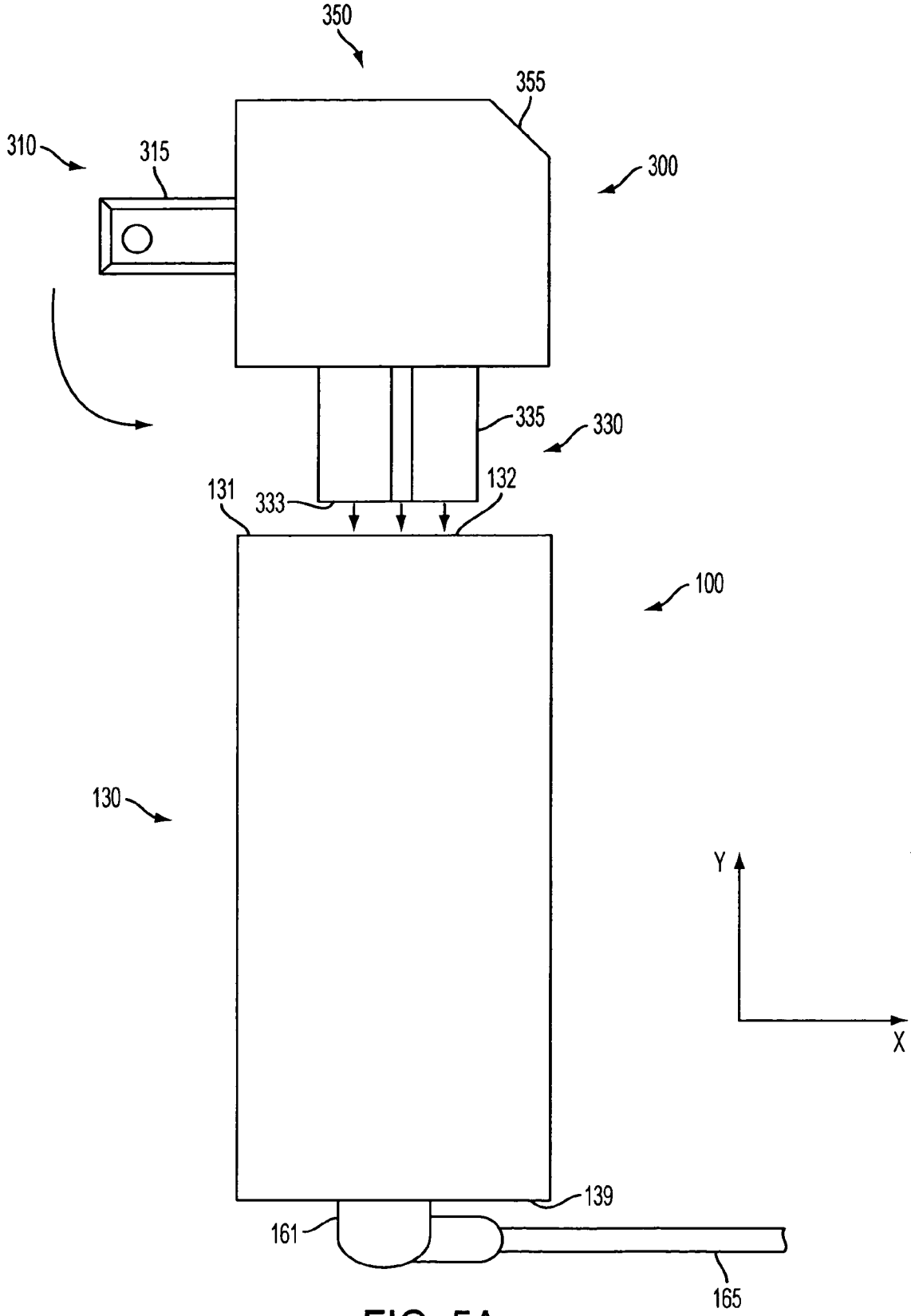
FIGS. 5A and 5B illustrate front and side views of an illustrative embodiment of an AC adapter assembly.
Figure 5B:
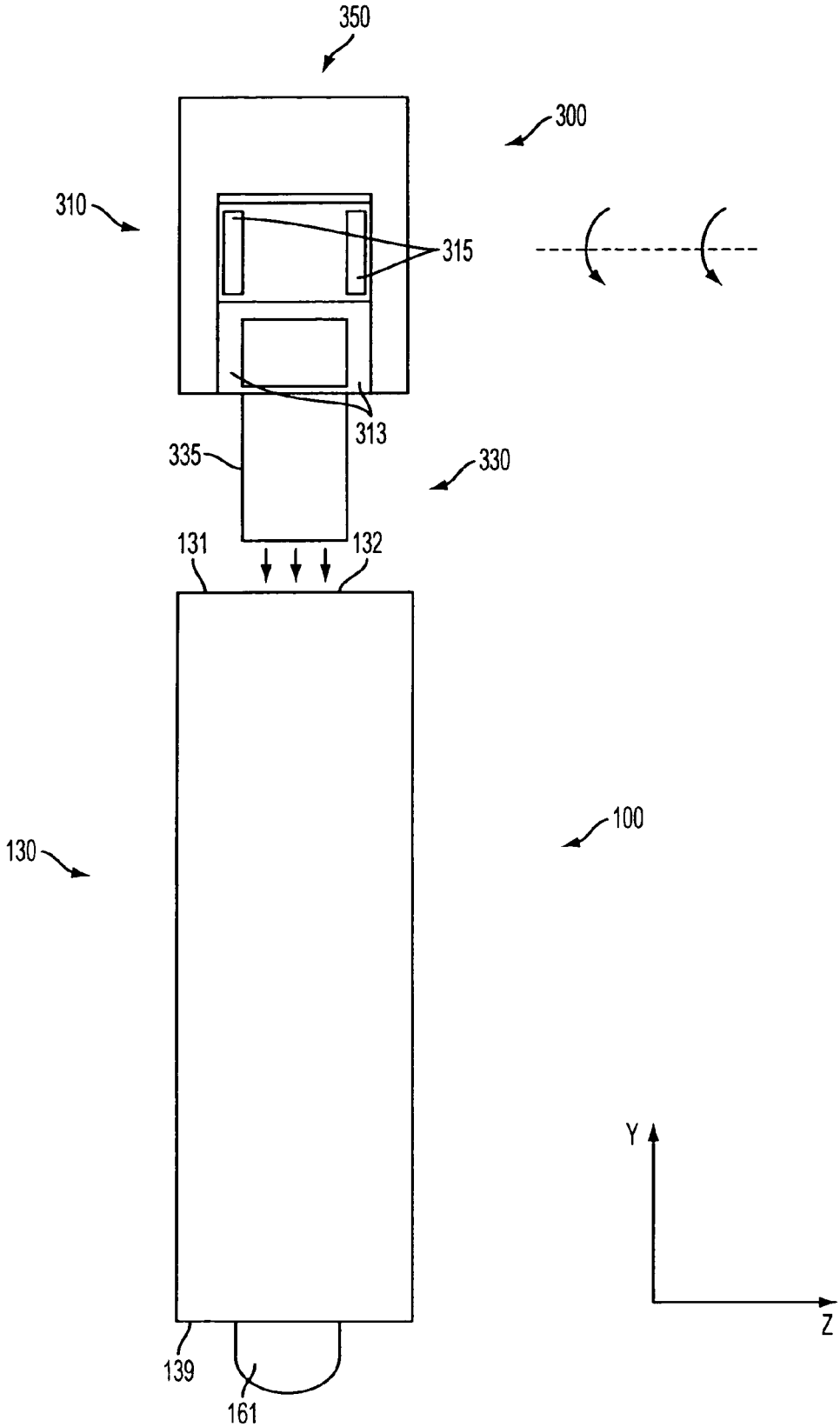

FIGS. 5A and 5B illustrate front and side views of an illustrative embodiment of an AC adapter assembly 100. Specifically, this particular embodiment depicts an AC adapter assembly including a wall socket connector 300 similar to that depicted in FIGS. 3A and 3B. Specifically, wall socket connector 300 is connected to adapter 130 at input end 131 by AC input connector member 330. Typically, AC input connector member 330 including conduit 335 which contains inlet connector 333 connects to connector 132A located within input side 131 of adapter 100 as depicted.

Various embodiments of adapter 130 are well known in the art and adapter 130 may possess any of the electronic characteristics of those adapters that are commonly known. Among the most obvious characteristics adapter 130 may possess is the ability to convert AC to DC via components within adapter 130. Further, adapter 130 typically possesses a rectangular shape, however, adapters having a different shapes are in existence. While adapter 130 may have any shape known in the art, adapter 130 will typically be rectangular in shape as this is the most common shape used. Additionally, using a rectangular adapter facilitates mating and alignment in an adapter assembly with a wall socket connector configured like the illustrative wall socket connector depicted in FIGS. 3A, 3B, 4A, and 4B.

Adapter 130 also typically includes an output end 139 to which DC connector 160 is attached. DC connector 160 typically links adapter 130, which converts AC to DC, to devices intended to receive DC current. DC connector 160 may include DC input connector 161 which connects to output end 139 of adapter and DC output connector 169 which may connect directly to a portable computer. Connecting DC input connector 161 and DC output connector may be a cord 165 which typically is flexible and permits three dimensional movement of DC input connector 161 and DC output connector 169 relative to each other. DC connectors are well known in the art and any conventional DC connector may be used.

However, one specific DC connector 160 may be used in conjunction with wall socket connector 300 to provide a further embodiment of an AC adapter assembly (not depicted). When wall socket connector 300 as previously described is combined with a DC connector 160 with a retractable cord, an AC adapter assembly is formed. Specifically, wall socket connector 300 may placed in a storage position, e.g. FIGS. 4A and 4B, in which wall socket connector possess smooth rectangular edges without prongs 315 protruding from housing 350. Additionally, by combining this feature in an AC adapter assembly with a DC connector 160 having a retractable cord, an AC adapter with improved transportability qualities is formed. Such an AC adapter assembly would be easily connected to a wall socket and possess a cord that could be extended to a wall that was some distance away from an adapter 130 itself, however, the AC adapter assembly could also be compacted by retracting the cord of the DC connector 160 and rotating prongs 315 of he wall socket connector to create a pocket-sized AC adapter assembly when placed in a storage position.

Certain embodiments of adapter assemblies, for example the embodiment depicted in FIGS. 5A–5B may be constructed by, for example a user, connecting a wall socket connector 300 to an adapter assembly 100. Similarly the same assembly may be deconstructed in a similar but opposite fashion as construction took place. Alternatively, FIGS. 6A and 6B illustrate front and side views respectively of another illustrative embodiment of an AC adapter assembly.

Figure 6A:
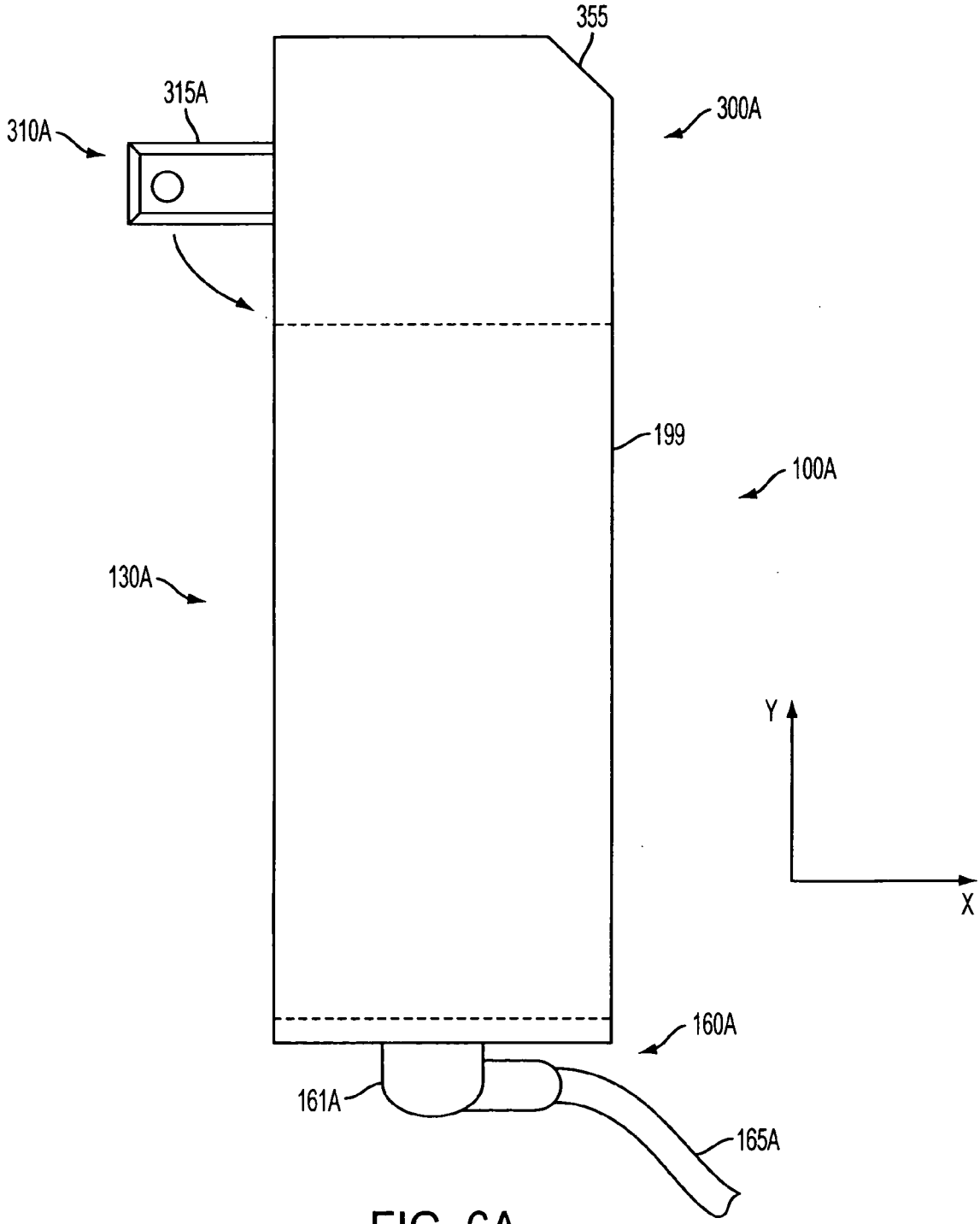
FIGS. 6A and 6B illustrate front and side views of another illustrative embodiment of an AC adapter assembly.
Figure 6B:
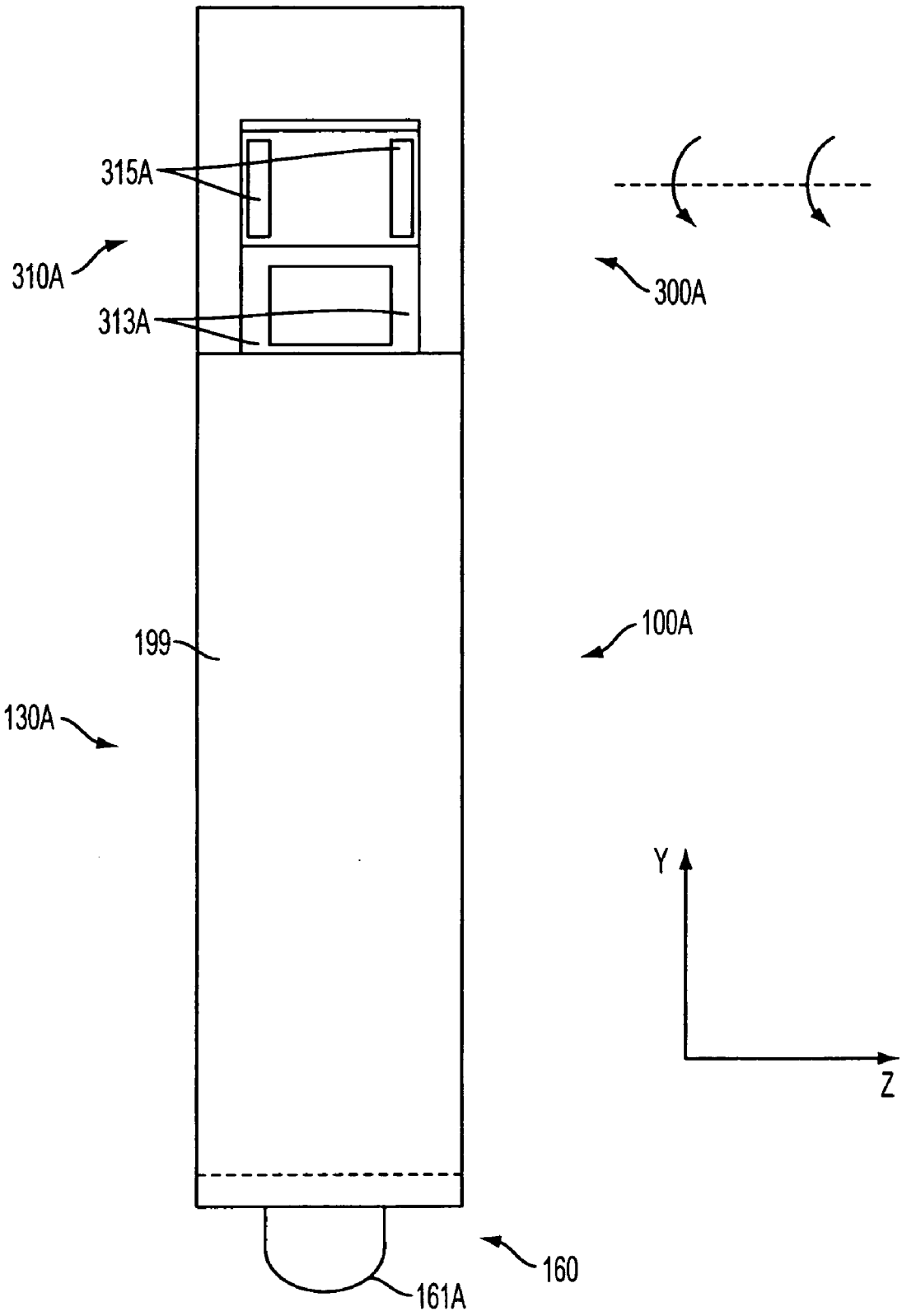

In particular, the illustrative embodiment depicted in FIGS. 6A and 6B may be described as a fully integrated AC adapter assembly 100A. The illustrative fully integrated AC adapter assembly 100A includes wall socket connector 300A, DC connector 160A, an adapting component (not visible) for transforming AC to DC for use by a portable computer, and a wall socket connecting element 310A including prongs 315A. In general for each of the listed illustrative features, for example the wall socket connector 300A, its operation has already described with respect to the previous embodiments. Additionally, broken lines depict an illustrative theoretical demarcation line to show location of certain features, for example the location of wall socket connector 300A. However, these lines do not necessarily exist and are only for illustrative purposes as AC adapter assembly 100A is a fully integrated assembly and the boundaries of certain described features may be alternately located and/or completely removed.

The embodiment in FIGS. 6A and 6B varies from the previous described embodiments in that wall socket connector 300, the adapting component contained with adapter 130A, and DC connector 160A are fully integrated into a single body. Many of the features are non-removable. This full integration further enables an adapter assembly 100A to be formed that in an in-use position efficiently provides the requisite DC to a portable computer. Integration also enables AC adapter assembly 100A to possess characteristics, especially when positioned in a storage position, that allow AC adapter assembly 100A to be easily and conveniently transported including for example placement in a briefcase, a shirt pocket, or hand bag. Other fully integrated AC adapter assemblies consistent with the embodiment depicted in FIGS. 6A–6B and described here may have other additional features. For example, DC connector 160A may include a retractable cord or a rigid connector. Additionally, a retracting mechanism may also be fully integrated within housing 199. Also, in another embodiment, fully integrated AC adapter assembly 100A may be fully contained with housing 199 with the exception of a single solid DC connector protruding from AC adapter assembly 100.

Figure 7:
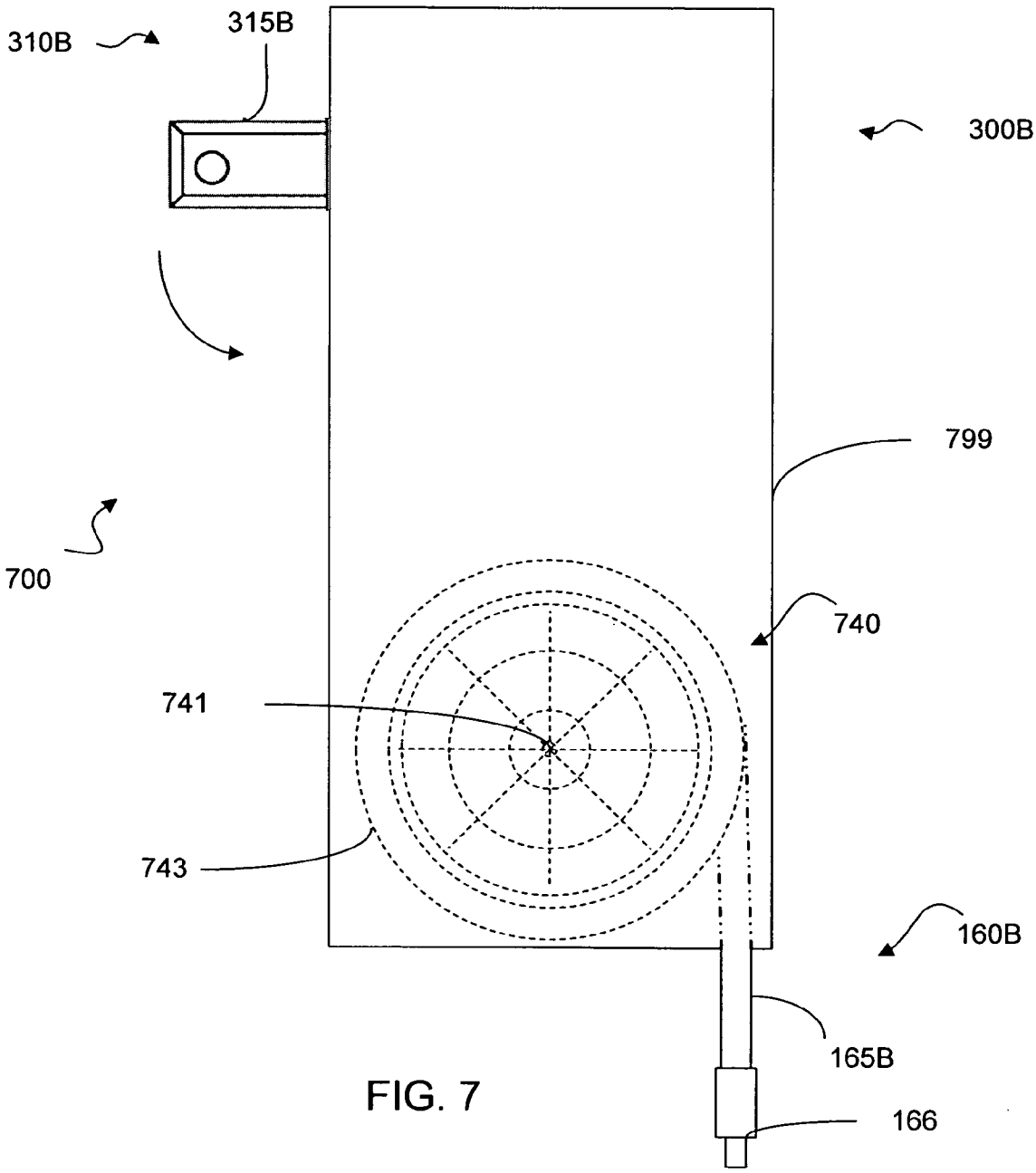
FIG. 7 illustrates an exemplary AC adapter assembly including a retraction mechanism.

As previously mentioned, the AC adapter assembly described herein may have a retractable feature including a retractable cord 165B. FIG. 7 illustrates an example of an AC adapter assembly 700 including a retraction mechanism 740. AC adapter 700 includes wall socket connector 300B having wall socket connecting element 310B and prongs 315B. On an opposing end, the AC assembly 700 includes DC connector 160B, a portion of which includes retraction mechanism 740. The retraction mechanism 740 may be housed in housing 799 as depicted. Accordingly, the referenced components may not be externally visible and are therefore shown in broken lines. Retraction mechanism 740 may include a biased wheel 743, which may be frictionally rotated around a pivot 741. As the biased wheel 743 is rotated in a first direction by a user applying a force pulling retractable cord 165B, the length of retractable cord 165B that is moved outside hosing 799 is increased. In a similar fashion, various lengths of retractable cord 165B can be accomplished allowing significant variability to the user depending on the length of cord required by a user including various positioning locations of connector 166 for connection to an electronic device including laptop or notebook computers. Additionally, by supplying a comparatively slight pulling force to activate a biasing mechanism of any type known in the art, the biased wheel 743 may be caused to rotate in the reverse position thereby shortening the length of retractable cord 165B until it returns to a housed position similar to the position shown in FIG. 7. Various other specific configurations and particular retraction mechanisms may be used in a related fashion to provide user versatility as previously described herein.

While aspects of the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

I claim:

1. A wall socket connector for an AC adapter comprising:

a wall socket connecting element including a plurality of prongs rotateable in unison and configured to rest in complimentary recesses of a wall socket;

an AC input connector member having a mating surface complimentary to an inlet connector; and a housing rotateably connecting the wall socket connecting element and the AC input connector so as to permit the plurality of prongs of the wall socket connecting element to be rotated about two perpendicular axis of rotation.

2. The wall socket connector for an AC adapter of claim 1, wherein the inlet connector is an IEC-320 C8 inlet connector.

3. The wall socket connector for an AC adapter of claim 1, further comprising a user assisting element.

4. The wall socket connector for an AC adapter of claim 3, wherein the user assisting element is a chamfered corner.

5. The wall socket connector for an AC adapter of claim 1, further comprising in-use and storage positions, wherein a portion of the plurality of prongs is continuously exterior to the housing during a transition from the in-use position to the storage position.

6. The wall socket connector for an AC adapter of claim 5, wherein the direction of rotation of the plurality of prongs during the transition from the in-use position to the storage position is towards the AC input connector member.

7. The wall socket connector for an AC adapter of claim 6, wherein the maximum angle of rotation of the plurality of prongs about each of the perpendicular axis of rotation is 90 degrees.

8. The wall socket connector for an AC adapter of claim 7, further comprising a rectangular shape and a minimum dimension measuring less than one inch.

9. An AC adapter assembly comprising:

an adapter including an adapter AC input on a first end and a adapter DC output on a second opposing end;

a wall socket connector including a plurality of prongs configured for insertion into a wall socket and an AC input connector member configured for insertion into the input of the adapter, the plurality of prongs being rotateable about two perpendicular axis of rotation; and a DC connector including a DC connector input configured to connect to the adapter DC output, a DC connector output, and a linking member movably connecting the DC connector input and DC connector output, wherein the wall socket connector, the adapter and the DC connector are operably connected such that AC input to the plurality of prongs of the wall socket connector is converted to DC and output by the adapter DC output.

10. The AC adapter assembly of claim 9, wherein a minimum dimension of each of the adapter, the wall socket connector and the DC connector does not exceed one inch.

11. The AC adapter assembly of claim 9, wherein the wall socket output of the wall socket output connector is an IEC 320-C8 plug.

12. The AC adapter assembly of claim 9, further comprising a de-constructable arrangement wherein the adapter, the wall socket connector and the DC connector are configured so as to each be completely removable components.

13. The AC adapter assembly of claim 9, wherein the DC connector is retractable.

14. The AC adapter assembly of claim 13, the DC connector further including a retractable cord.

15. The AC adapter assembly of claim 14, wherein the retractable cord is self-winding.

16. An AC adapter assembly comprising:

a wall socket connecting element for receiving AC from a wall socket including a plurality of prongs rotateable through a range of rotation in each of a first plane and a second plane, the first and second planes being perpendicular;

an adapting component for transforming input AC to DC for output;

a DC connector for outputting DC; and a housing containing the adapting component, wall socket connecting element, and DC connector, wherein the adapting component, the wall socket connecting element, and the DC connector are fully integrated within the housing.

17. The AC adapter assembly of claim 16, wherein the DC connector includes a retractable cord and is contained completely within a perimeter of the housing in the storage position.

18. The AC adapter assembly of claim 16, further comprising:

an in-use position in which the plurality of prongs of the wall socket connecting element are positioned to run substantially perpendicular to a longest dimension of the housing and a storage position in which the plurality of prongs of the wall socket connecting element are positioned to run substantially parallel to a longest dimension of the housing.

19. The AC adapter assembly of claim 18, the housing being configured such that a transition from the in-use position to the storage position includes rotation of the plurality of prongs towards the DC connector about a first axis.

20. The AC adapter assembly of claim 19, the housing being configured such that a transition from the in-use position to the storage position includes rotation of the wall socket connecting element about a second axis perpendicular to the first axis.

* * * * *